US005671645A

United States Patent [19]

Murayama et al.

[11] Patent Number: 5,671,645

[45] Date of Patent: Sep. 30, 1997

[54] SCREW SUPPLY DEVICE FOR COUPLED SCREW TIGHTENING MACHINE

[75] Inventors: Keishiro Murayama; Osamu Ebisawa, both of Tokyo, Japan

[73] Assignee: Max Co., Ltd., Tokyo, Japan

[21] Appl. No.: 540,043

[22] Filed: Oct. 6, 1995

[30] Foreign Application Priority Data

Oct. 6, 1994 [JP] Japan ..... 6-268247

[51] Int. Cl.[6] ..... B25B 23/06

[52] U.S. Cl. ..... 81/434; 227/136

[58] Field of Search ..... 81/57.37, 434, 81/435, 433; 227/135, 136, 139, 107

[56] References Cited

U.S. PATENT DOCUMENTS

| | | | |
|---|---|---|---|
| 4,428,261 | 1/1984 | Takatsu et al. | 81/434 |
| 5,083,483 | 1/1992 | Takagi | 81/434 |
| 5,339,713 | 8/1994 | Hou | 81/434 |
| 5,402,695 | 4/1995 | Hornung | 81/434 |

FOREIGN PATENT DOCUMENTS

| | | |
|---|---|---|
| 59-41022 | 11/1984 | Japan . |
| 59-41022 Y2 | 11/1984 | Japan . |

OTHER PUBLICATIONS

General and Mechanical, pp. 1671–1672.

*Primary Examiner*—D. S. Meislin
*Assistant Examiner*—Joni B. Danganan
*Attorney, Agent, or Firm*—Cushman Darby & Cushman, IP Group of Pillsbury Madison & Sutro, LLP

[57] ABSTRACT

A drive link is coupled to an end of a ratchet wheel, and the other end of the drive link is slidably arranged in a guide hole formed in a side wall of a nose holder. The nose holder has a control plate rotatably attached to the other end of the drive link. The control plate is urged by a spring so as to engage with the other end of the drive link with such a strength as to temporarily stop the movement of the drive link when the drive link is in the course of retreating together with the nose portion. The other end of the drive link is designed to engage with a front end of the guide hole while the nose portion is in the course of advancing from a retreat end. By causing the ratchet wheel to make a forward/backward rotation based on stoppage of the drive link while the nose portion is in the course of retreating and while the nose portion is in the course of advancing, a feed wheel is rotated intermittently in a coupled screw feed direction.

8 Claims, 8 Drawing Sheets

SCREW SUPPLY DEVICE FOR COUPLED SCREW TIGHTENING MACHINE

BACKGROUND OF THE INVENTION

The invention relates to a screw supply device for a coupled screw tightening machine which is capable of feeding coupled screws efficiently.

As a screw supply device of this type, the one disclosed in Examined Japanese Utility Model Publication No. Sho. 59-41022 is generally known. This device has the following construction. Coupled screw feed wheels and a ratchet wheel engageable with the feed wheels are placed in an upper portion inside a casing which is slidably arranged in an adaptor in a front portion of a screw tightening machine main body. These feed wheels are intermittently rotated only one pitch by the ratchet wheel at the end of a return stroke of the casing after the screwing operation has been completed.

However, as shown in FIG. 14 of the above publication, the thus constructed screw supply device is characterized in that a ratchet pawl which is rotatably arranged on a front end portion of a feed rod stops with a state of traversing the ratchet wheel after the end of the screwing operation (at the end of the screwing stroke). That is, the conventional screw supply device is characterized as stopping itself after the ratchet pawl advances in the screwing direction to the screwing side that is further forward than the ratchet wheel during the pushing stroke. As a result of this construction, it is necessary to provide a space or a relief portion in advance in an area into which the ratchet pawl advances. The arrangement of the space or the relief portion not only makes the total length of the device long but also gives restrictions on the design of a portion around the ratchet wheel.

SUMMARY OF THE INVENTION

The invention has been made to overcome the above problems. The object of the invention is, therefore, to provide a coupled screw tightening machine whose pushing stroke is particularly short, whose total length is shorter than the conventional example, and which is thus made compact.

To achieve the above object, the invention is applied to a screw supply device for a coupled screw tightening machine which tightens one of coupled screws fed to a nose portion slidably accommodated into a nose holder arranged in a front portion of a main body, the screw supply device comprising: a pair of feed wheels rotatably supported within the nose portion, each engageable with at least one of coupled screws; a pair of ratchet wheels supported concentrically with the feed wheels, rotatable in a forward/backward direction, and engageable with the respective feed wheels only when the ratchet wheels rotate in a single direction; a pair of guide holes formed in respective side walls of the nose holder, the guide holes extending axially; a pair of drive links coupled at one end thereof to a portion close to an outer edge of the respective ratchet wheels, and the other end thereof being arranged slidably along the respective guide holes; a pair of control plates pivotally provided in the nose holder, the control plates being engagable with the other end of the respective drive links; and a pair of springs urging the control plates respectively, wherein a strength of the springs is enough to temporarily stop only the retreating of the drive links when the other end of the drive links engages with the control plates, wherein the other end of the drive links is in contact with a front end of the guide holes when the nose portion is on the way of advancing from a retreat end, and wherein the feed wheels are rotated intermittently in a coupled screw feed direction by causing the ratchet wheels to make a forward/backward rotation based on stoppage of the drive links while the nose portion is on the way of retreating and while the nose portion is in the course of advancing.

According to the above construction, the nose portion is pushed back into the nose holder while squeezed onto a surface of a member to be screwed, so that the driver bit advances relative to the nose portion to thereby screw the member to be screwed. At the same time, each drive link retreats relative to the nose holder together with the corresponding ratchet wheel, causing the other end of the drive link to retreat along the corresponding guide hole to thereby engage with the control plate in the middle of the pushing stroke. Although the drive link stops, the nose portion continues retreating. Therefore, the ratchet wheel makes a forward movement. Since the ratchet wheel does not engage with the corresponding feed wheel at this instance, only the ratchet wheel rotates idly, leaving the corresponding feed wheel not rotating. As the nose portion further retreats, the drive link disengages the control plate, causing the other end of the drive link to move as far as a pushing stroke end.

When the nose portion is moved away from the member to be screwed to cause the nose portion to make a return operation after the screwing operation has been completed, the other end of the drive link engages with the control plate again in the course of a return stroke. Since the control plate is not stopped in this case, the ratchet wheel does not rotate. When the nose portion further advances, the other end of the drive link engages with the front end of the guide hole. Although the other end of the drive link cannot advance any further, the nose portion continuous advancing. As a result, the ratchet wheel is reversely rotated by the drive link. At this instance, the ratchet wheel engages with the feed wheel, which causes the feed wheel to be rotated by the ratchet wheel in the coupled screw feed direction, allowing a single coupled screw to be supplied.

As described above, the feed wheels make an intermittent rotation every time the nose portion moves forward and backward, feeding a screw during the return operation of the nose portion.

Further, the ratchet wheels make a forward rotation in the middle of the pushing stroke in which the nose portion is pushed by the control plate.

DETAILED DESCRIPTION OF THE PREFERRED EMBODIMENTS

Figure 1:
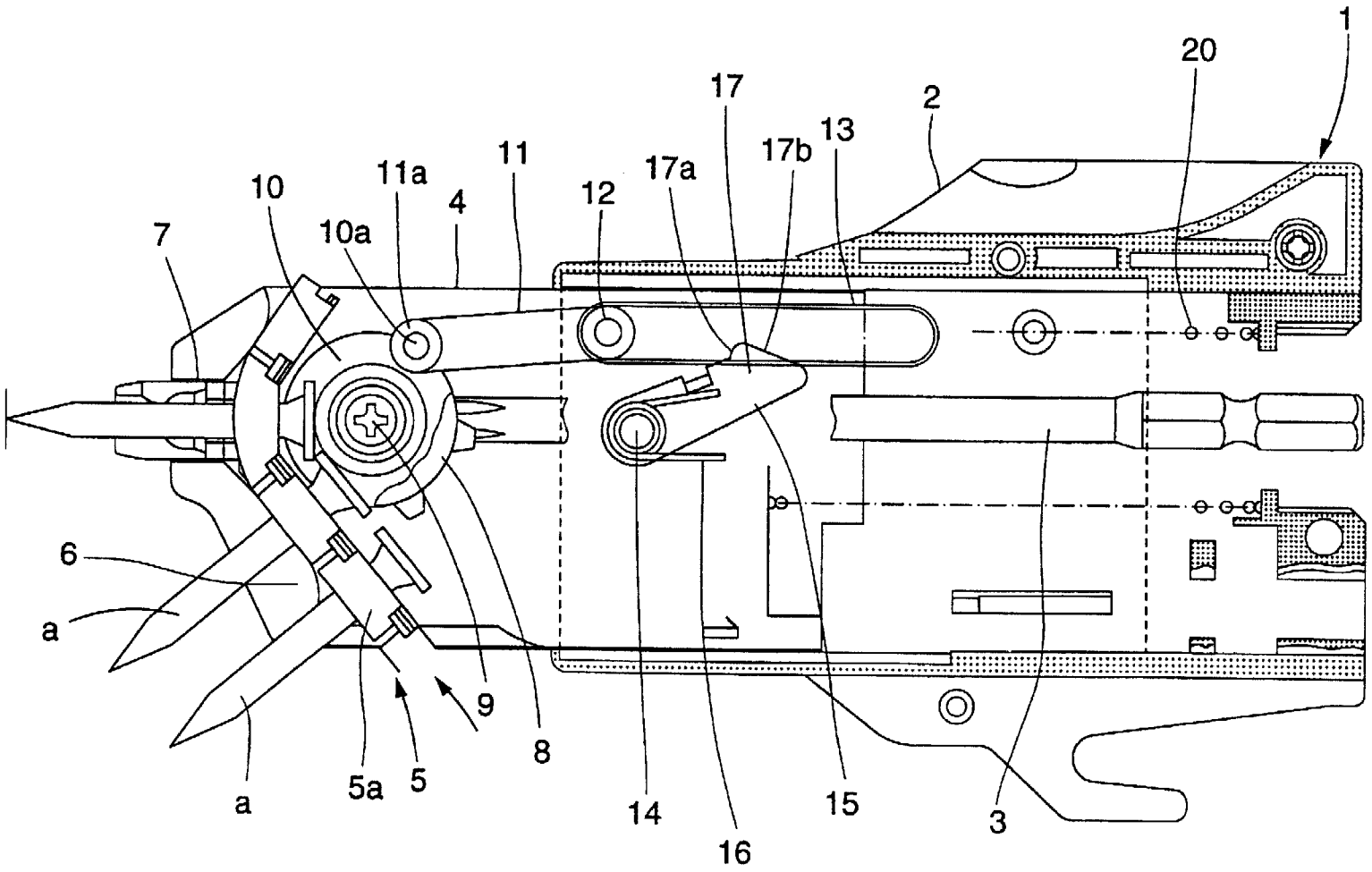
FIG. 1 is a side view of a screw feed device of the invention.
Figure 2:
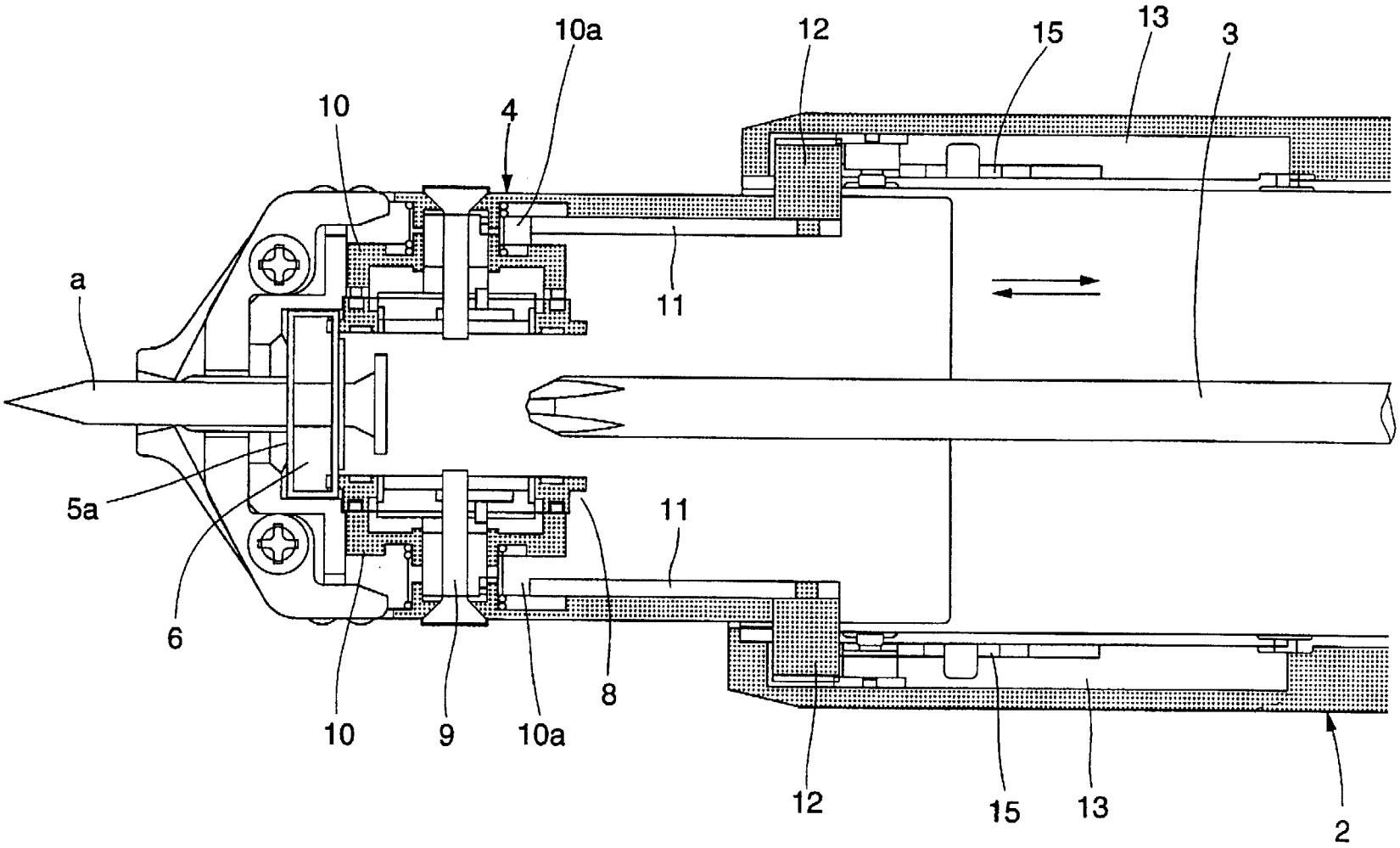
FIG. 2 is a top view of the screw feed device.

In FIGS. 1 and 2, reference numeral 1 denotes a screw tightening machine main body. A cylindrical nose holder 2 is arranged at a front end portion of the screw tightening machine main body 1. A driver bit 3 and a drive mechanism therefor are arranged in the screw tightening machine main body 1. The nose holder 2 holds a nose portion 4 so as to be slidable forward and backward (in an axial direction of the driver bit 3). The nose portion 4 is urged forward at all times by a spring 20. A coupled screw passage 6 is formed in the front of the nose portion 4. The coupled screw passage 6 guides through coupled screws 5 upward from bottom. It may be noted that the coupled screws 5 are formed by holding screws a in a coupling belt 5*a* (usually made of synthetic resin) at an interval.

At the time of turning a screw, the screw is fed to a screw hammering section 7 formed along the passage 6, and the front end of the nose portion 4 is then squeezed onto a surface of a member to be screwed to cause the nose portion 4 to retreat so that the nose portion 4 is pushed back into the nose holder 2 (pushing stroke). During this pushing stroke, the driver bit 3 advances relative to the retreating of the nose portion 4, which allows the front end of the driver bit 3 to engage with a slotted head of the screw a and causes the screw a to be turned into the member to be screwed. By moving the nose portion 4 away from the screw after the screw turning operation has been completed, the nose portion 4 is caused to advance by the spring force (return stroke), and returns to the original position during this return stroke.

A screw supply device that sequentially feeds the coupled screws 5 to the screw hammering section 7 has the following construction.

The nose portion 4 has a pair of feed wheels 8 right and left, each feed wheel 8 being engageable with the coupling belt 5*a* holding the coupled screws 5. Outside each feed wheel 8 is a ratchet wheel 10. The ratchet wheel 10 is supported by the corresponding feed wheel 8 concentrically with a rotating shaft 9 of the corresponding feed wheel 8 so as to overlap each other.

Figure 3:
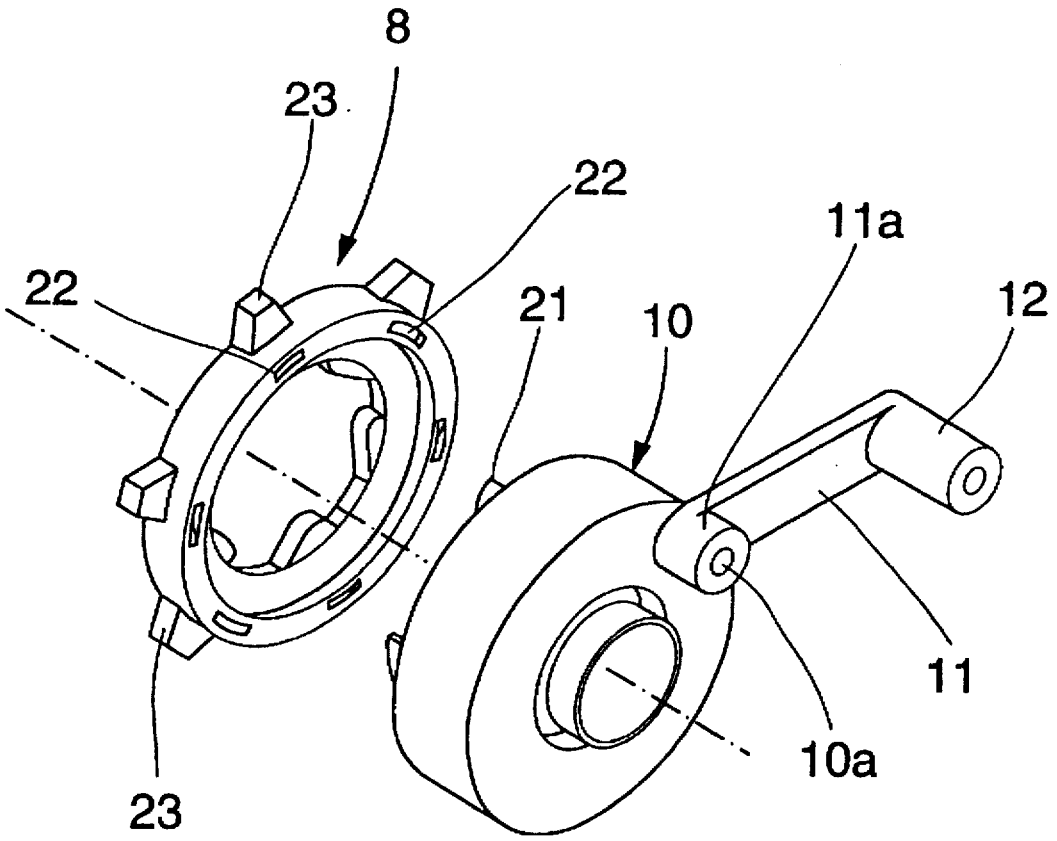
FIG. 3 is an exploded perspective view of a ratchet wheel and a feed wheel.

Ratchet pawls 21 are circumferentially arranged at an equal interval on the inner side surface of each ratchet wheel 10 as shown in FIG. 3. On the other hand, engagement grooves 22 are formed in the outer side surface of each feed wheel 8 so as to correspond to the ratchet pawls 21. The engagement groove 22 is engaged with the corresponding ratchet pawl 21 only when the ratchet pawl moves in a single direction. Therefore, when the ratchet wheel 10 rotates in a single direction (in the clockwise direction as viewed in FIG. 1), the ratchet pawls 21 engage with the engagement grooves 22 to cause the corresponding feed wheel 8 to rotate. When the ratchet wheel 10 rotates reversely (in the counterclockwise direction as viewed in FIG. 1), the ratchet pawls 21 do not engage with the engagement grooves 22, nor does the feed wheel 8 rotate as the feed wheel is engaged with a check pawl (not shown). As a result, the feed wheel 8 rotates intermittently based on the forward/backward rotation of the Corresponding ratchet wheel 10. Engagement pawls 23 engageable with the coupling belt 5*a* (see FIG. 1) of the coupled screws 5 are formed on the outer circumference of each feed wheel 8, so that the coupled screws 5 are fed on a single screw basis every time the feed wheel 8 rotates intermittently.

A mechanism for rotating each ratchet wheel 10 forward and backward will be described.

An end 11*a* of a drive link 11 is coupled to a shaft portion 10*a* close to an outer edge portion of the ratchet wheel 10. A projected portion 12 (or a roller) projecting sideways is attached to the other end of the drive link 11. The projected portion 12 is arranged so as to be slidable into an axially extending guide hole 13 formed in a side wall of the nose holder 2. When the nose portion 4 is in a retreat end (pushing stroke end), the projected portion 12 on the other end of the drive link 11 is at a position forward of the rear end of the guide hole 13, and the projected portion 12 on the other end of the drive link 11 comes in engagement with the front end of the guide hole 13 during the course of a return stroke in which the nose portion 4 advances while moving away from the retreat end.

In contrast thereto, in the nose holder 2 a control plate 15 is rotatably attached to a pivot 14 that is arranged adjacent to the guide hole 13. This control plate 15 is urged by a torsion coil spring 16 at all times so that the front end of the control plate 15 engages with the projected portion 12 on the other end of the drive link 11 sliding along the guide hole 13, i.e., the front end of the control plate 15 advances substantially into the middle portion of the guide hole 13 in a side view shown in FIG. 1. A front end portion 17 of the control plate 15 which advances into the guide hole 13 is formed into a triangle so that the control plate 15 engages with the projected portion 12 obliquely. It may be noted that the front end portion 17 is inclined so that a front side 17a of the front end portion 17 is largely inclined and a rear side 17b thereof is mildly inclined.

It may be noted that the torsion coil spring 16 is set to such a strength that the front end portion of the control plate 15 can temporarily stop the movement of the drive link 11 when the front end portion comes in engagement with the drive link 11. In other words, the torsion coil spring 16 is set to such a strength that the control plate 15 can temporarily stop the drive link 11 while functioning as sliding resistance against the projected portion 12 of the drive link 11.

Figure 4:
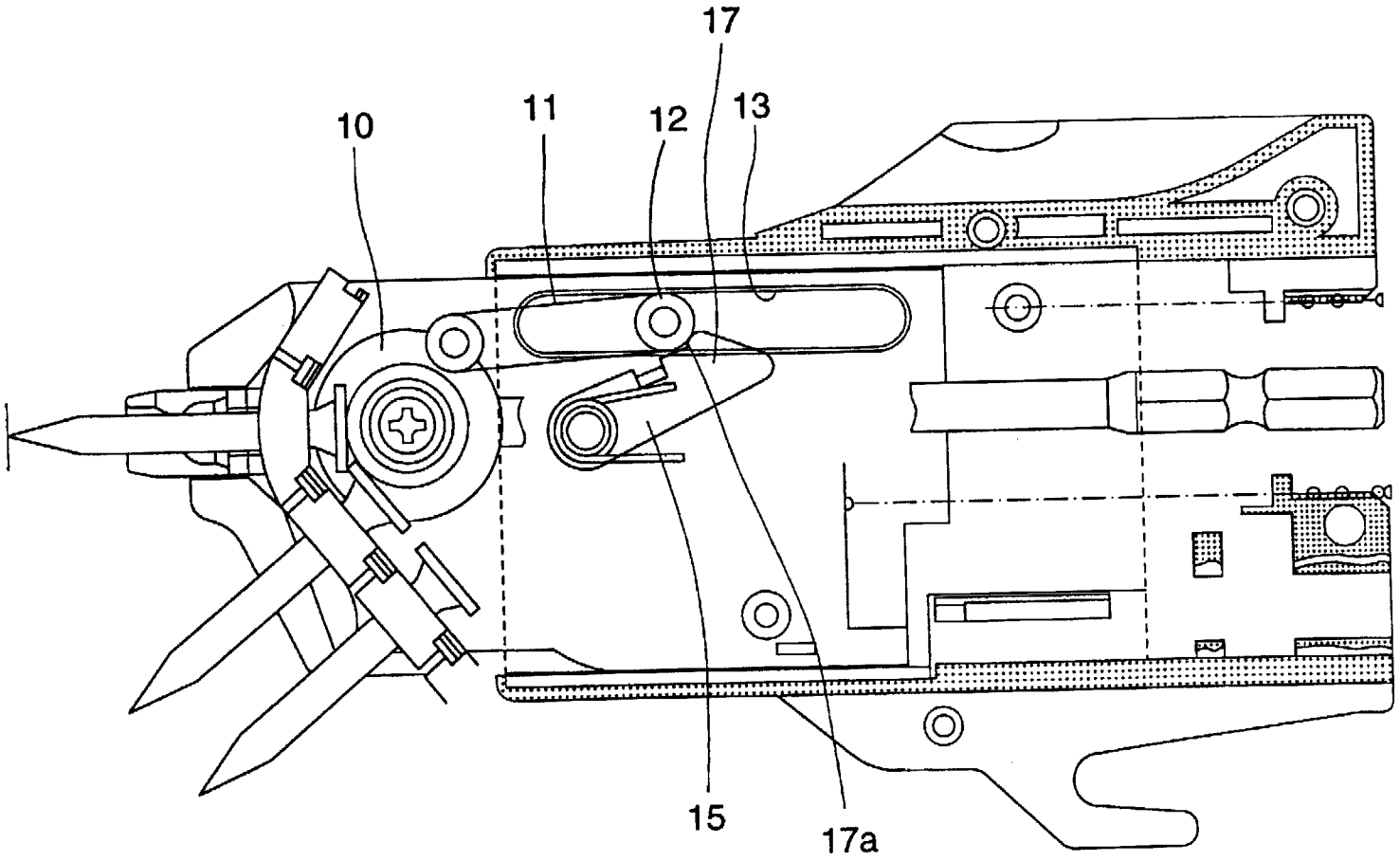
FIG. 4 shows a mode of operation of the screw feed device during a pushing stroke.
Figure 5:
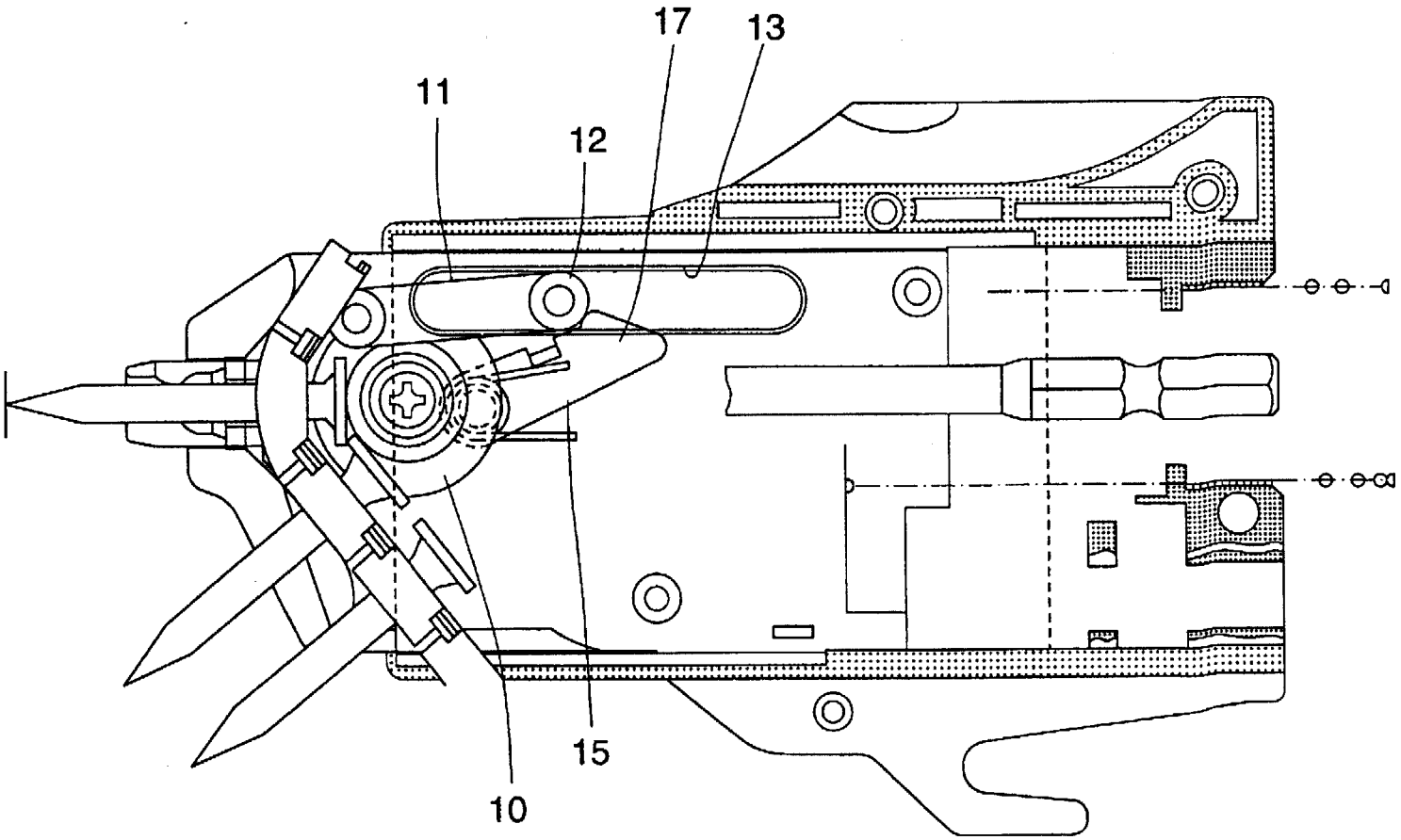
FIG. 5 shows a mode of operation of the screw feed device during a pushing stroke.
Figure 6:
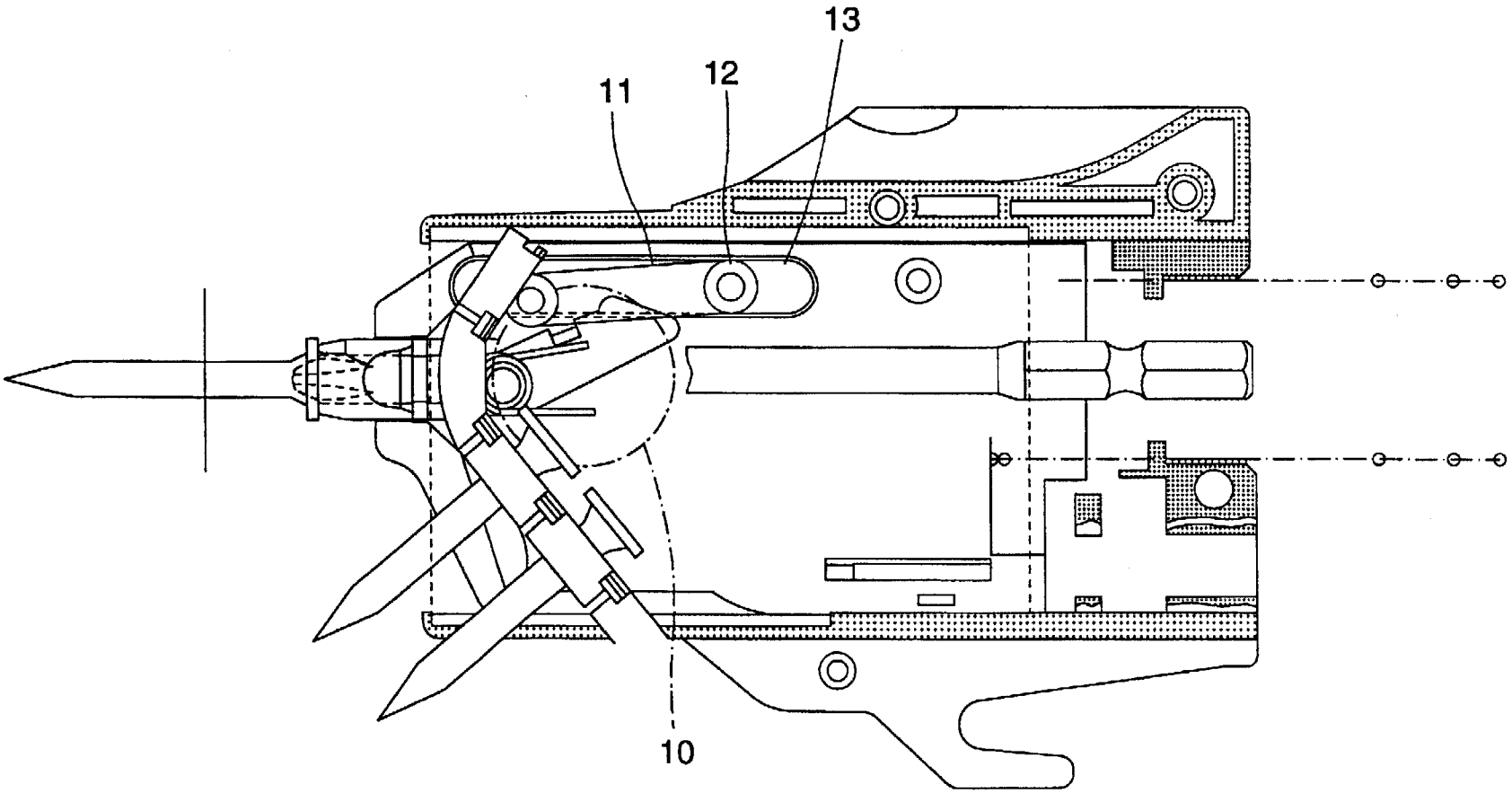
FIG. 6 shows a mode of operation of the screw feed device at a pushing stroke end.

According to the aforementioned screw supply device, the nose portion 4 is pushed back into the nose holder 2 while squeezed onto the surface of the member to be screwed, so that the driver bit 3 advances relative to the nose portion 4 to turn a screw into the member to be screwed as shown in FIGS. 4 and 5. At the same time, the drive link 11 also retreats relative to the nose holder 2 together with the ratchet wheel 10, which causes the projected portion 12 of the drive link 11 to retreat along the guide hole 13 of the nose holder 2, engaging with the front side 17*a* of the front end portion 17 of the control plate 15 in the first half of the pushing stroke. The drive link 11 stops moving, whereas the nose portion 4 continues retreating, which causes the ratchet wheel 10 to make a forward rotation in the counterclockwise direction. Since the ratchet pawls do not engage with the engagement grooves of the feed wheel 8 at this instance, only the ratchet wheel 10 rotates idly, not causing the feed wheel 8 to rotate. The rotation of the ratchet wheel 10 causes each of the ratchet pawls to engage with the next respective engagement groove of the feed wheel 8. When the nose portion 4 further retreats, the drive link 11 disengages the control plate 15, causing the projected portion 12 of the drive link 11 to move as far as the pushing stroke end as shown in FIG. 6.

Figure 7:
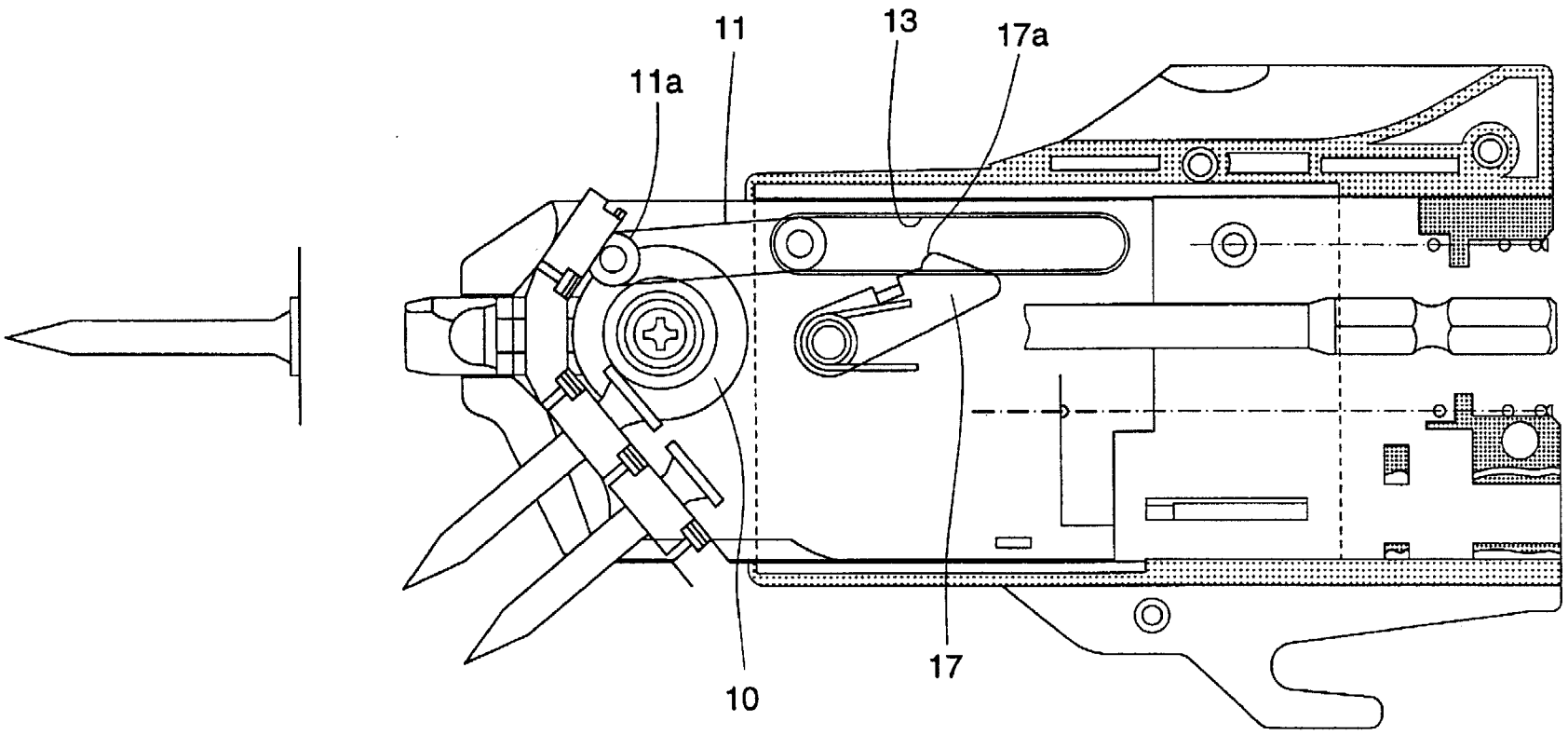
FIG. 7 shows a mode of operation of the screw feed device during a return stroke.
Figure 8:
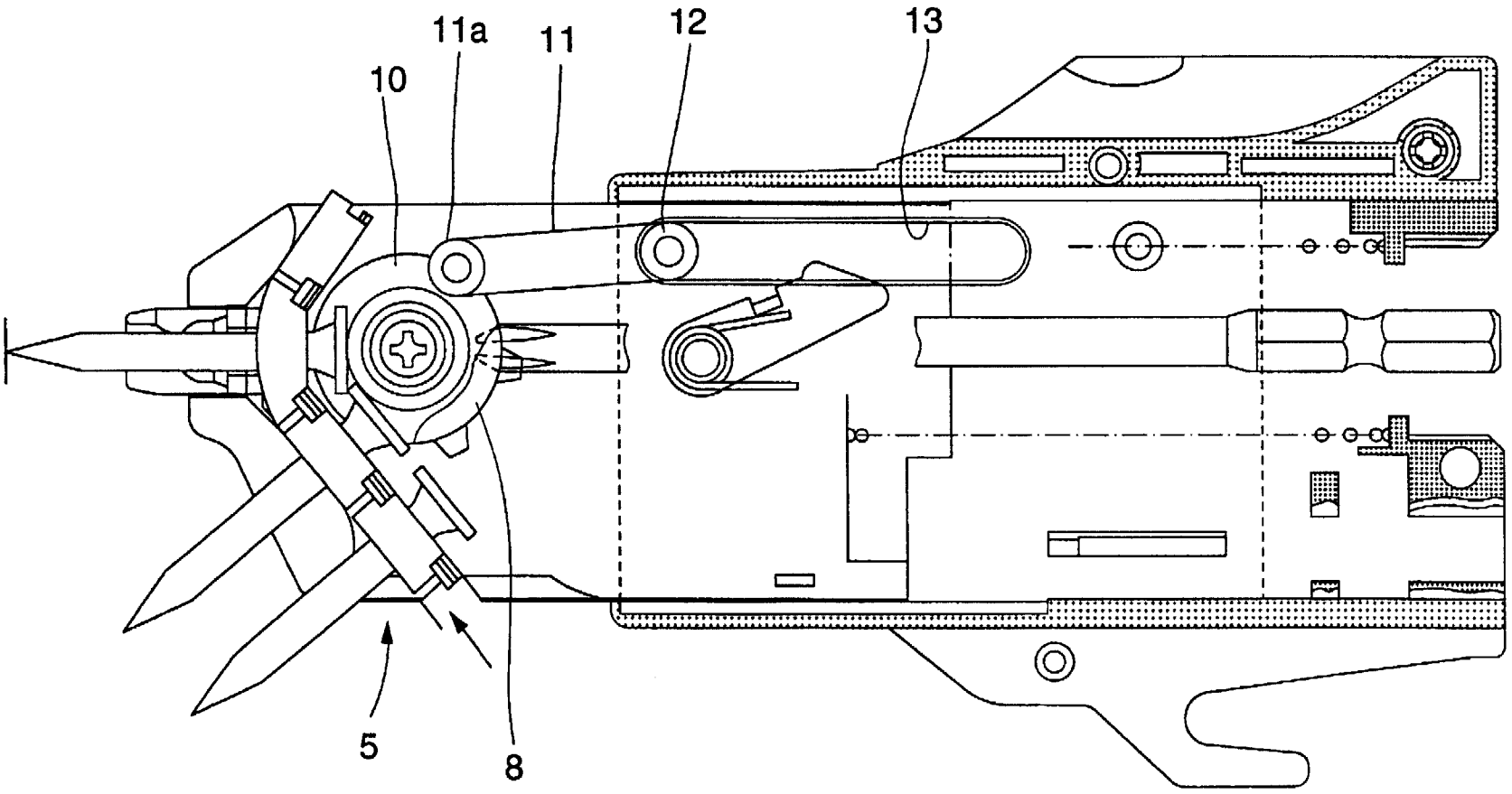
FIG. 8 shows a mode of operation of the screw feed device at a return stroke end.

When the nose portion 4 is moved away from the member to be screwed after the screwing operation has been completed, the nose portion 4 moves away from the nose holder 2 by the force of a spring 20 to advance, thereby returning to the original position. During this return stroke, the projected portion 12 of the drive link 11 engages with the rear side 17*b* of the front end portion 17 of the control plate 15. Since the inclination of the rear side 17*b* of the front end portion 17 is mild and the projected portion 12 of the drive link 11 drives the front end portion 17 of the control plate 15 out of the guide hole 13, the ratchet wheel 10 does not rotate. As the nose portion 4 further advances, the projected portion 12 of the drive link 11 engages with the front end of the guide hole 13 (see FIG. 7), not allowing the projected portion 12 to advance any further. Since the nose portion 4 continues advancing, the ratchet wheel 10 is returned in the opposite direction (in the clockwise direction) by the drive link 11 as shown in FIG. 8. Since the ratchet pawls of the ratchet wheel 10 engage with the engagement grooves of the feed wheel at this instance, the feed wheel 8 rotates in the coupled screw feed direction (in the clockwise direction), causing a single coupled screw 5 to be supplied to the screw hammering section 7.

As described in the foregoing, each feed wheel 8 rotates intermittently only once per one forward/backward movement (one cycle of reciprocating movement) of the nose portion 4, and a screw is fed when the nose portion 4 makes a return to the original position.

The screw supply device described above has a pair of ratchet wheels, a pair of drive links and a pair of control plates. It may be provided that the screw supply device has a ratchet wheel, a drive link and a control plate on only one side thereof.

According to the invention, the forward/backward rotation of each ratchet wheel 10 is performed in the middle of the nose portion pushing stroke and at the end of the nose portion return stroke. Therefore, not only the pushing stroke can be shortened, but also the rear portion of the guide hole is no longer used for screw feeding. Hence, the total stroke can be shortened.

Moreover, according to the aforementioned screw feed device, there are no parts and components that advance in front of the feed wheels. Therefore, the mechanism around the feed wheels can be simplified, which in turn contributes to shortening the total length of the coupled screw 5 turning machine and hence to implementing a compact machine.

What is claimed is:

1. A screw supply device for a coupled screw tightening machine which tightens one of coupled screws fed to a nose portion slidably accommodated into a nose holder arranged in a front portion of a main body, said screw supply device comprising:

a pair of feed wheels rotatably supported within the nose portion, each engageable with at least one of coupled screws;

a pair of ratchet wheels supported concentrically with said feed wheels, rotatable in a forward/backward direction, and engageable with said respective feed wheels only when said ratchet wheels rotate in a single direction;

a pair of guide holes formed in respective side walls of the nose holder, said guide holes extending axially;

a pair of drive links coupled at one end thereof to a portion close to an outer edge of said respective ratchet wheels, and the other end thereof being arranged slidably along said respective guide holes;

a pair of control plates pivotally provided in the nose holder, said control plates being engagable with the other end of said respective drive links; and a pair of springs urging said control plates respectively, wherein a strength of said springs is enough to temporarily stop only the retreating of said drive links when said the other end of said drive links engages with said control plates, wherein the other end of said drive links is in contact with a front end of said guide holes when the nose portion is on the way of advancing from a retreat end, and wherein said feed wheels are rotated intermittently in a coupled screw feed direction by causing said ratchet wheels to make a forward/backward rotation based on stoppage of said drive links while the nose portion is on the way of retreating and while the nose portion is in the course of advancing.

2. A screw supply device according to claim 1, wherein each of said control plates having a front inclined portion and a rear inclined portion being mildly inclined than said front inclined portion.

3. A screw supply device according to claim 2, wherein said front inclined portion and said rear inclined portion of said control plates are positioned to be engagable with the other end of said drive links.

4. A screw supply device according to claim 1, wherein each of said ratchet wheels has ratchet pawls circumferentially arranged at an equal interval on an inner side surface thereof, and wherein each of said feed wheels has engagement grooves and engagement pawls, said engagement grooves being formed in an outer side surface thereof at the same interval as said ratchet pawls, said engagement pawls being formed on an outer circumference thereof.

5. A screw supply device for a coupled screw tightening machine which tightens one of coupled screws fed to a nose portion slidably accommodated into a nose holder arranged in a front portion of a main body, said screw supply device comprising:

a pair of feed wheels provided in the nose portion, said feed wheels being engageable with at least one of coupled screws and rotatable as one unit;

a ratchet wheel supported concentrically with one of said feed wheels, rotatable in a forward/backward direction, and engageable with said feed wheels only when said ratchet wheels rotate in a single direction;

a guide hole formed in one of side walls of the nose holder, said guide hole extending axially;

a drive link coupled at one end thereof to a portion close to an outer edge of said one of said ratchet wheel, and the other end thereof being arranged slidably along said guide hole;

a control plate pivotally provided in the nose holder, said control plate being engagable with the other end of said drive link; and a spring urging said control plate, wherein a strength of said spring is enough to temporarily stop only the retreating of said drive link when said the other end of said drive link engages with said control plate, wherein the other end of said drive link is in contact with a front end of said guide hole when the nose portion is on the way of advancing from a retreat end, and wherein said feed wheels are rotated intermittently in a coupled screw feed direction by causing said ratchet wheel to make a forward/backward rotation based on stoppage of said drive link while the nose portion is on the way of retreating and while the nose portion is in the course of advancing.

6. A screw supply device according to claim 5, wherein said control plate having a front inclined portion and a rear inclined portion being mildly inclined than said front inclined portion.

7. A screw supply device according to claim 6, wherein said front inclined portion and said rear inclined portion of said control plate are positioned to be engagable with the other end of said drive link.

8. A screw supply device according to claim 5, wherein said ratchet wheel has ratchet pawls circumferentially arranged at an equal interval on an inner side surface thereof, and wherein each of said feed wheels has engagement grooves and engagement pawls, said engagement grooves being formed in an outer side surface thereof at the same interval as said ratchet pawls, said engagement pawls being formed on an outer circumference thereof.

* * * * *